US005522418A

United States Patent [19]

Johnson et al.

[11] Patent Number: 5,522,418

[45] Date of Patent: Jun. 4, 1996

[54] DIFFERENTIAL PRESSURE OPERATED GAS LIFT VALVE

[76] Inventors: Larry Johnson, 102 Villeve Cir., Lafayette, La. 70506; Robert A. Kendrick, Rte. 3, Box 243 Rabon Chapel Rd., Montgomery, Tex. 77356

[21] Appl. No.: 336,003

[22] Filed: Nov. 8, 1994

[51] Int. Cl.[6] ..... F16K 24/06

[52] U.S. Cl. ..... 137/155; 417/109

[58] Field of Search ..... 137/155; 417/109

[56] References Cited

U.S. PATENT DOCUMENTS 2,305,250 12/1942 Garrett et al. ..... 417/117

*Primary Examiner*—Gerald A. Michalsky

*Attorney, Agent, or Firm*—Bush, Moseley, Riddle & Jackson

[57] ABSTRACT

A differential pressure operated gas lift includes a valve element movable in a tubular body to open and close a gas flow passage having flow restricting orifices upstream thereof. A coil spring tends to open the valve element. In the open position of the valve element an external pressure responsive surface engages a seat which is axially adjustable to vary the spring force and change the length of travel of the valve element between its open and closed positions. The reopening differential pressure can be changed while maintaining the same closing pressure differential. Very large injection rates can be implemented at low differential pressures.

14 Claims, 2 Drawing Sheets

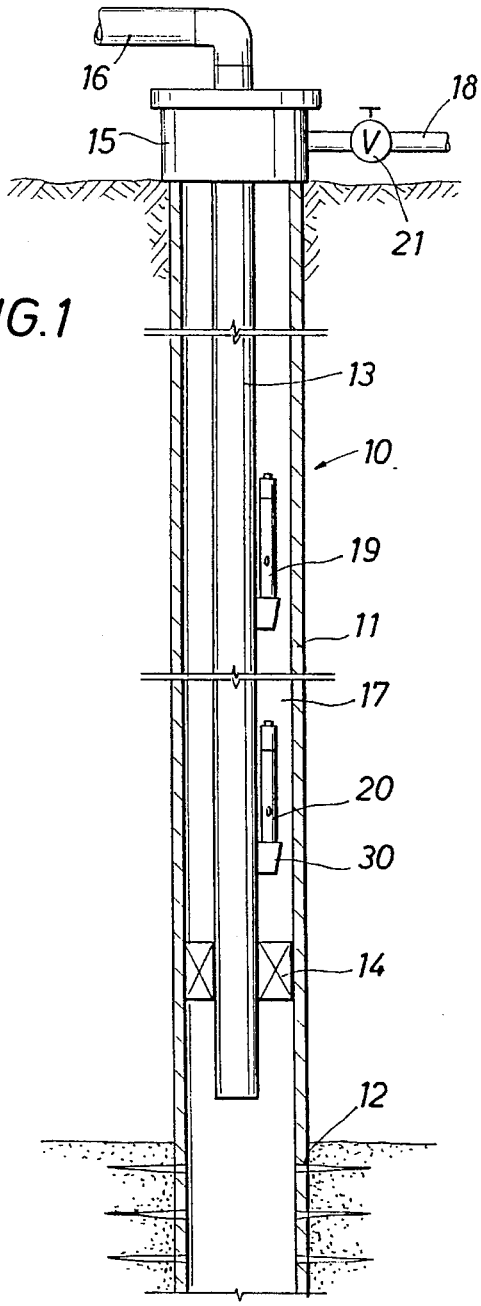
FIG. 1
FIG. 2A
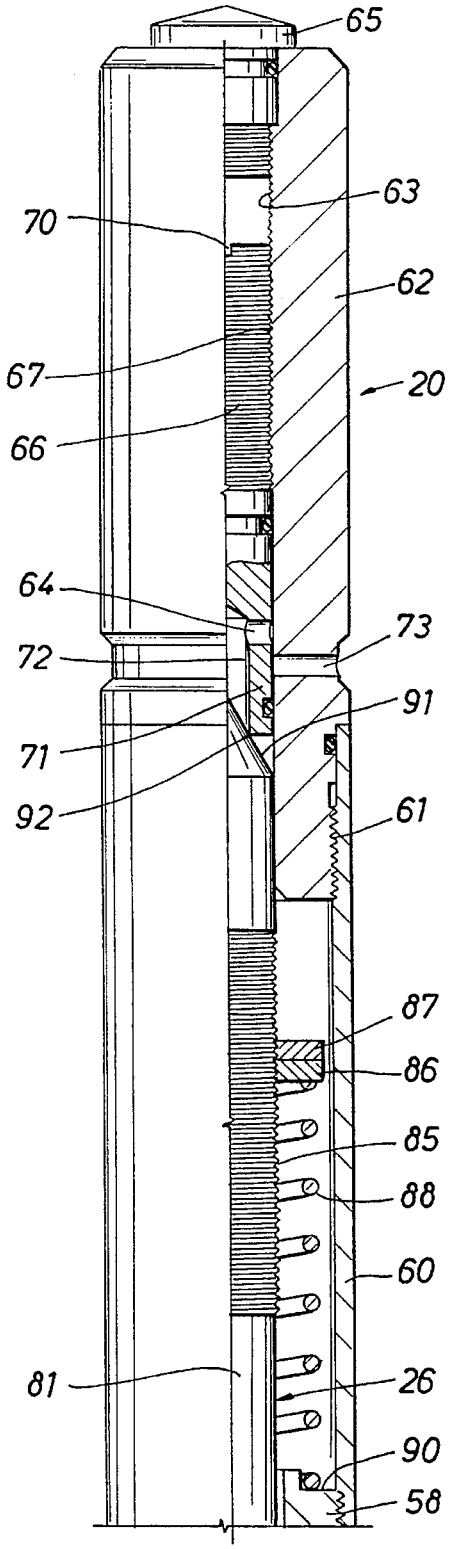
FIG. 4
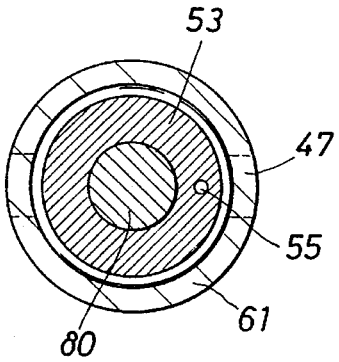

DIFFERENTIAL PRESSURE OPERATED GAS LIFT VALVE

FIELD OF THE INVENTION

This invention relates generally to a gas lift valve used in artificially lifting fluid from a well, and particularly to a differential pressure operated gas lift valve having a reopening pressure that is adjustable while the closing pressure differential remains the same.

BACKGROUND OF THE INVENTION

Gas lift is one of several artificial lift systems that can be employed to produce an oil well which does not have sufficient natural bottom hole pressure to cause the oil to flow up through a production string of tubing to the surface. Gas lift also can be used to increase the production from a well having marginal flow of oil at the surface. In either case, gas under pressure is pumped into the casing-to-tubing annulus at the surface and enters the production tubing downhole via one or more flow regulator-type devices called gas lift valves. The gas is entrained into and mixes with the oil to reduce its density so that available bottom hole pressure is sufficient to cause the oil to flow to the surface at a desired rate. A surface separation facility can be used to separate the lift gas from the oil so that the gas can be reinjected into the annulus. This type of artificial lift is in widespread use in oil producing areas where natural gas is readily available.

The use of gas lift valves as a means of artificial lift is believed to have began in the early 1930's. One of the first types to be used was a differential pressure responsive device having a spring-loaded piston subject on one end to tubing pressure and as its other end to casing pressure. Injection gas enters the valve body through one or more flow restrictions which are smaller than the valve port so that a reduced pressure acts on the valve stem. The valve element normally is held open by the spring and requires a certain differential between annulus gas pressure and the reduced pressure to close. Thus as long as the tubing pressure has been sufficiently reduced by entrained gas that the oil is flowing, the valve remains closed. However when tubing pressure rises to a level where flow might cease, the differential pressure is reduced and the spring opens the valve to admit gas into the tubing and reduce the density of the oil. For a general discussion of the principles and theory of this type gas lift valve, see "Principles of Oil Well Production", Second Ed., Nind, McGraw-Hill, at pp. 192–196, and the disclosure of U.S. Pat. No. 3,559,672 relating to FIG. 9 thereof.

Although differential pressure-type gas lift valves in theory offer the most efficient method of gas lifting known, they have embodied several practical problems which have limited their potential. For example the valve element tends to cycle between open and closed positions before assuming either position, which causes unnecessary wear on the valve parts and erratic operation. Moreover, reopening pressure has been essentially the same as closing pressure which is undesirable during the unloading or start-up phase of a gas lift installation because it can result in multiple valves being open at the same time, which can result in stopping the unloading process without ever reaching the desired point of injection.

In the early 1940's U.S. Pat. No. 2,305,250 addressed some but not all of these problems by proposing the use of unequal areas at the upper and lower ends of the valve piston. This feature caused more positive opening and closing of the valve dement to reduce undesirable cycling. However by the late 1940's the dome pressure operated bellows valve became quite popular and has substantially diminished the market for other types of valves since that time. Although a dome pressure valve is not particularly efficient, efficiency was not an important or controlling criteria when natural gas was cheap and oil production was regulated to only a few days per month. Of course it is quite clear that the economy now has changed radically, and that production of remaining oil must be optimized if adequate profits are to be realized.

An object of the present invention is to provide a new and improved differential pressure gas lift valve that optimizes gas lift operations.

Another object of the present invention is to provide a new and improved differential pressure gas lift valve that includes means to allow the reopening pressure differential to be adjustable while the closing pressure differential remains the same.

Another object of the present invention is to provide a new and improved gas lift valve of the differential pressure type which has a large valve seat size and long stem travel which allow high gas injection rates with minimum pressure drop.

Yet another object of the present invention is to provide a new and improved gas lift valve of the differential type that can be used in high volume oil wells requiring large gas injection rates.

SUMMARY OF THE INVENTION

These and other objects are attained in accordance with the present invention through the provision of a gas lift valve including a housing having a gas flow passage, a first seat surrounding the passage, and orifice means through which gas can flow toward and through the seat. An elongate valve member is movable in the housing between a closed position against the first seat where gas flow is shut off, and an open position that allows injection of gas through the passage and seat and into the tubing. A spring having an adjustable initial compression tends to move the valve member to the open position. When open the opposite end of the valve member engages a second seat in the housing which is axially adjustable with respect to the first seat. The differential pressure required to close the valve element is developed across the area of the second seat, and is a function of the rate and length of initial compression of the spring. On the other hand the pressure differential required to reopen the valve is developed across the area of the first seat and is a function of spring rate and length of initial compression plus its additional length of compression due to valve travel. The axial position of the second seat within the housing can be changed or adjusted to correspondingly change the length of travel of the valve member and thus the level of spring force tending to reopen the valve. The relatively long valve member travel ensures that it has only minimal effects on gas passage when open, and allows use of the present invention in high volume oil wells requiring large gas injection rates.

BRIEF DESCRIPTION OF THE DRAWINGS

The present invention has the above as well as other objects, features and advantages which will become more clearly appreciated in connection with the following detailed description of a preferred embodiment, taken in conjunction with the appended drawings in which:

FIG. 1 is a schematic view of a producing oil well including gas lift valves on the production string;

FIG. 4 is a cross-section on line 4—4 of FIG. 2.

DETAILED DESCRIPTION OF A PREFERRED EMBODIMENT

Figure 2B:
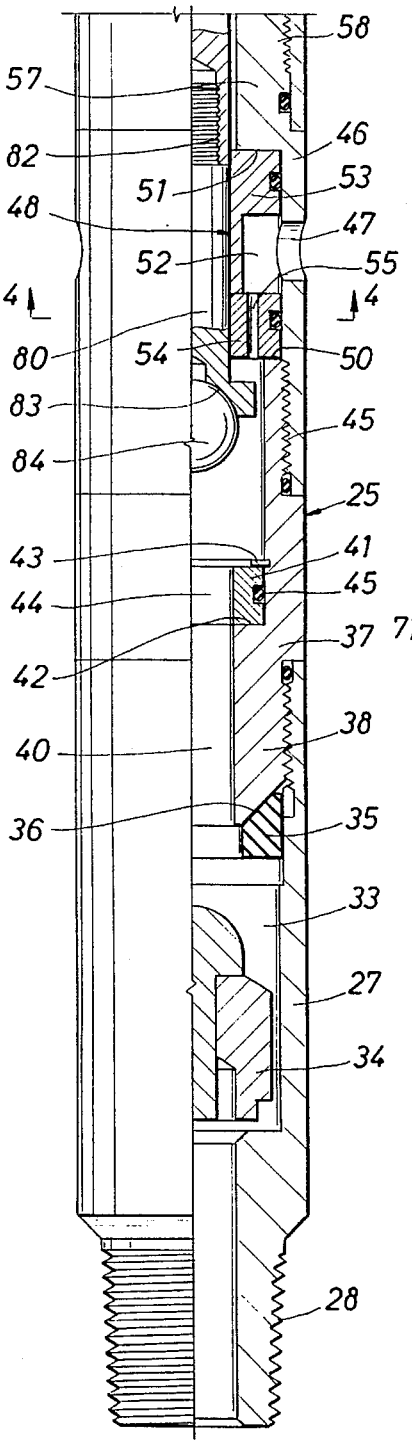
FIG. 2 is a longitudinal view of the present invention with the valve open and with the right side in section and the left side in elevation.

Referring initially to FIG. 1, an oil well 10 is lined with casing 11 that is perforated at 12 so that oil from a production zone can enter the casing. A production tubing 13 extends from the surface down to a packer 14 which is set above the perforations 12 so that the oil must flow up the tubing to the surface, through a casing head 15 and into a production line 16. A series of spaced-apart gas lift valves 19 and 20 are mounted on the tubing 13, and the lowermost valve 20 is arranged to control the injection of gas from the annulus 17 into the tubing. The gas is supplied to the annulus 17 at the surface by a suitable compressor (not shown) through the line 18 via a valve 21. The lift valves 19 typically are used only for initially "unloading" any liquids such as salt water in the annulus 17 down to the bottom valve 20. During such unloading a portion of the oil in the tubing 13 may also be unloaded. In any event the valve 20 is used to aerate the oil column in the tubing 13 with gas so that the natural pressure of the oil in the production zone is sufficient to lift the reduced density oil to the surface. Once gas lift is initiated the upper valves 19 remain closed. In fact the valve 20 will prevent the adjacent pressure in the tubing 13 from rising to a level where the oil cannot be produced to the surface.

As shown in FIG. 2, the valve 20 includes a tubular valve body 25 having a valve member indicated generally at 26 movably arranged therein. The body 25 includes a lower sub 27 having external threads 28 by which the valve is secured to a lug 30 (FIG. 1 ) on the outside of the tubing 13. The lug 30 typically is welded to the tubing 13 and has a passage that communicates with a radial port through the wall thereof. The sub 27 forms an internal cavity 33 that receives a check valve 34 which can shift up in response to flow velocity and engage an annular seal 35 to prevent back flow of oil to the outside of the tubing 13. However the check valve 34 automatically moves down to its open position, as shown, when gas is being injected into the tubing 13. The seal 35 engages a shoulder 36 provided by an adapter sleeve 37 whose lower end is threaded to the sub 27 at 38. The respective bores of the adapter sleeve 37 and the lower sub 27 provide a gas flow passage 40. The threads 38, as well as all other threaded connections between housing components are sealed as shown against fluid leakage.

Figure 3A:
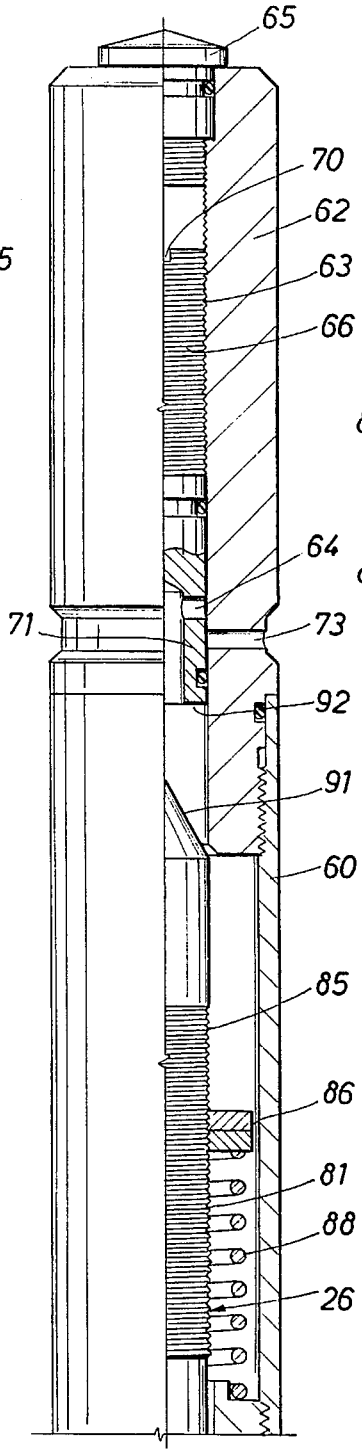
FIG. 3 is a view like FIG. 2 with the valve closed.
Figure 3B:
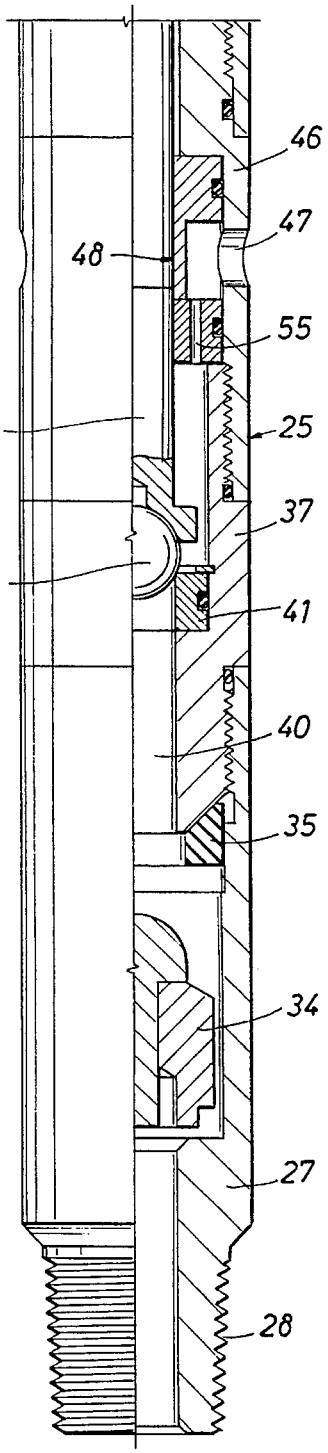

A seat ring 41 is held against a shoulder 42 in the sleeve 37 by a retainer 43. Thus the bore 44 of the seat 41 surrounds the flow passage 40. A seal ring 45 prevents leakage. The upper end of the sleeve 37 is threaded at 45 to a port sleeve 46 having one or more large gas entry ports 47 through the wall thereof. An orifice spool 48 is mounted between the upper end surface 50 of the sleeve 37 and a downwardly facing shoulder 51 on the port sleeve 46. The spool 48 has an external annular recess 52 formed therein which provides upper and lower flanges 53, 54. The lower flange 54 has an axially extending orifice 55 so that gas on the outside of the housing or body 25 which enters through the ports 47 can flow into the passage 40 above the seat ring 41. However the flow is considerably restricted due to the relatively small size of the orifice 55 so that the pressure in the passage 40 in the vicinity of the seat 41 is reduced. Appropriate seal rings prevent leakage past the outer surfaces of the flanges 53, 54 of the spool 47. Although one orifice 55 is shown in FIGS. 2–4, more than one could be used to provide a cumulative flow area that meets design criteria.

The upper end portion 57 of the port sleeve 46 is threaded at 58 to the lower end of a spring housing tube 60, and the upper end of the tube 60 is threaded at 61 to the lower end of an upper sub 62. The sub 62 has an internal bore 63 which is threaded throughout its upper portion. A sealed plug 65 is threaded into the upper end of the sub 62 to close the upper end of the internal bore 63. An adjustment mandrel 66 is positioned in the bore 63 and has external threads 67 which engage the internal threads on the sub 62 to provide an axial cam arrangement that is responsive to relative rotation. A slot 70 in the upper end of the mandrel 66 allows a tool such as a screwdriver to be used to thread the mandrel upward or downward in the sub 62 for purposes to be described below. The mandrel 66 has a depending skirt 71 which surrounds a blind bore 72 that is communicated to the outside of the sub 62 by radial ports 64 and 73. Of course the plug 65 can be temporarily removed to gain access to the adjustment mandrel 66.

The valve member 26 includes a lower stem 80 and an upper stem 81 that are threaded together at 82 as a rigid assembly. The lower stem 80 has a semi-spherical recess 83 on its lower end that mounts a spherical valve element or ball 84 that, when engaged with the upper inner edge of the seat ring 41, prevents gas flow in the downward direction and into the tubing 13. The ball element 84 can be secured in the recess 83 by any suitable means such as soldering. The stem 80 slides through the orifice spool 48 with a fairly close manufacturing tolerance as the valve member 26 moves between a lower closed position and an upper open position. The upper stem 81 of the valve member 26 has a length of external threads 85 that receive an adjusting nut 86 and a locking nut 87. A coiled compression spring 88 reacts between the adjusting nut 86 and an upwardly facing shoulder 90 on the adapter sleeve 37 and thus biases the valve member 26 in the upward or opening direction. The upper end surface 91 of the stem 81 is conically shaped and engages the lower inner edge 92 of the skirt 71 to stop upward movement of the valve element 26 in its open position, so that the axial position of the mandrel 66 determines the distance the valve element moves between closed and open positions. Such distance can be adjusted by threading the mandrel 66 upward or downward in the sub 62 with the valve element 26 stopped against the skirt 71. The initial preload force of the spring 88 in the opening direction is set by the position of the nuts 86 and 87 along the threads 85 on the upper stem 81. The transverse cross-sectional area at 92 is subject to differential pressure when the valve element 26 is open as shown in FIG. 2, whereas the transverse cross-sectional area inside the seat ring 41 is subject to a differential pressure when the valve element 26 is closed as shown in FIG. 3. In the open position the spring 88 exerts a preload force on the valve element 26 in the opening direction, and in the closed position this force is increased due to valve element travel and additional compression of the spring. The size of the area at 92 is somewhat smaller than the area of the seat ring bore 44.

The gas lift valve 20 of the present invention can readily be converted to a wireline retrievable device that can be run and set in a side pocket mandrel. The valve 20 would be run with a standard packing sub screwed onto the lower sub 27, and another typical packing sub and a running head would be connected to the upper sub 62. The valve assembly would then be run on a typical kickover tool and set in the side pocket of a mandrel which has gas flow slots or ports to the outside between polish bores in which the packings seat. Thus the exterior of the valve would be subject to gas pressure in the casing annulus while the closure ball 84 would be subject to pressure inside the tubing in the closed position.

In use and operation, the valve 20 is assembled as shown in the drawings and the threads 28 on the lower end of the valve body 25 are connected to a lug 30 on the outside of the production tubing 13 so that the outside of the valve 20 experiences gas pressure in the casing-to-tubing annulus 17. When the valve element 26 is in its lower or closed position, tubing pressure is present in the lower sub 27 and acts upward on the ball element 84 over a transverse area defined by the bore diameter of the seat 41, while external gas pressure acts downward on the same area. The coil spring 88 exerts upward force on the valve member 26 that is the sum of its preload force and the force due to additional compression as the valve shifted closed. Thus, the valve element 26 will shift upward to the open position when the opening force due to the spring predominates over the closing force due to pressure differential in favor of the casing annulus.

When the valve 20 is open as shown in FIG. 2, gas under pressure enters the large ports 47 in the adapter 46 and passes through the restricted orifice 55. From there the gas flows past the ball element 84, through the seat ring 41, past the check valve 34, and through the lug 30 into the bore of the tubing 13. The orifice 55 causes a drop in gas pressure so that a lesser pressure, which may be considered to be tubing pressure, acts upward on the valve element 26 over the transverse area bounded by the line of contact 92 between the stem surface 91 and the lower end of the skirt 71. Annulus gas pressure acts through the ports 73, 64 and downward and over the same area at 92. Initially the spring 88 applies upward force on the valve element 26 equal to its rate times the amount of initial compression thereof. When the force due to differential pressure across the area at 92 predominates over the spring force, the valve element 26 will shift downward and disengage from the skirt 71, which causes a larger transverse cross-sectional area defined by the diameter of the stem 80 to be subject to the differential pressure. Then the valve element 26 shifts rapidly downward while compressing the spring 88 until the ball element 84 engages the seat ring 41 to shut off gas flow as shown in FIG. 3. Such rapid movement prevents throttling. Thus the closing differential pressure value is a function of the initial compression or preload of the spring 88 as set by the position of the nut 86 along the stem 81 and the area of the stem 81 at 92. Once the valve 20 is closed, the tubing pressure acts upward on the valve element 26 over the bore area of the seat 41 and the reopening differential pressure is a function of precompression of spring 88. The amount of initial spring compression and thus the opening force attributable to it can be adjusted as described above, and the length of valve element travel can be adjusted by moving the mandrel 66 and its skirt 71 toward or away from the seat ring 41. This adjustment in turn sets the amount of additional spring force that will be applied in the opening direction once the valve element 26 is moved to its closed position as shown in FIG. 3. Moreover, the valve element travel can be shortened, for example, by threading the mandrel 66 downward, and the corresponding increase in preload of the spring 88 relieved by threading the nuts 86, 87 upward. Of course the opposite adjustments also can be made, or any combination thereof.

The equations which define the differential pressures required to close the valve 26, and that needed to reopen same, are as follows:

$$\text{Let: } \Delta P = P_C - P_T \qquad \text{(Eq. 1)}$$

where $\Delta P$=differential pressure in psi $P_C$=casing (annulus) pressure in psi $P_T$=tubing pressure in psi Then the closing pressure differential is:

$$\Delta P_{CL} = \frac{R_s \cdot X_P}{A_1} \qquad \text{(Eq. 2)}$$

where $\Delta P_{CL}$=differential pressure to close in psi $R_S$=spring rate in lb./in.

$X_P$=precompression of spring 88 in inches $A_1$= area of the skirt bore 72 in in.$^2$ and the opening (or reopening) pressure differential is:

$$\Delta P_{RO} = \frac{R_S (X_P + X_T)}{A_2} \qquad \text{(Eq. 3)}$$

where $\Delta P_{RO}$=differential pressure to open in psi $R_S$=spring rate in lb./in.

$X_P$=stem travel in inches $X_T$=compression of spring in inches $A_2$=area of seat ring bore 44 in in.$^2$ As a working example using the foregoing equations, when the area of the skirt ring bore 72 is 0.0277 in$^2$, the rate of the spring is 15 lb./in. and the precompression of the spring is 0.200 inches, the closing differential pressure calculated in accordance with Equation 2 is 108.3 psi. Thus for the valve element 26 to shift downward to close, the annulus gas pressure must be higher than tubing pressure by 108.3 psi. Where the area of seat ring bore 72 is 0.110 in$^2$ and the spring has been compressed an additional distance of 0.250 inch during closing movement, the differential pressure in favor of the tubing required to reopen the valve in accordance with Equation 3 is 61.4 psi or less.

Of course the objective of gas lift is to maintain the pressure in the tubing 13 at the level of the gas injection value 20 at a low enough value that the natural formation pressure of the oil is sufficient to cause the oil to flow to the surface and into a gathering facility or production line at an acceptable rate. Thus the valve 20 operates basically by sensing the tubing pressure adjacent the lug 30 and opening to admit lift gas when that pressure becomes too high, which is indicative of increased density of the oil column. At a certain pressure differential the spring 88 is able to pull the valve element 26 up to the open position so that gas is injected into the tubing 13. As the tubing pressure reduces due to reduced density of the oil on account of entrained gas bubbles, the net force due to difference in pressures between annulus gas pressure acting downward on the valve element 26 and reduced pressure acting upward thereon overpowers the spring 88 and causes the ball element 84 to close and terminate gas injection. The reduced pressure is due to restricted orifice 55 which has a flow area that is far less than the area of the gas entry ports 47 of the seat ring bore 44. The valve 20 will repeatedly open and close, as necessary, to maintain the oil density in the tubing 13 at an appropriate level.

In accordance with one aspect of the present invention, the reopening pressure differential can be set at different levels while maintaining the same differential closing pressure. Adjustment of the reopening pressure differential is accomplished by rotating the mandrel 66 to change the axial spacing between the skirt 71 and the seat ring 41. As the skirt 71 is moved closer to the seat ring 41 the total travel of the valve element 26 is reduced. The adjusting nut 86 is threaded upward along the stem 81 so that the output force of the spring 88 due to preload is the same. Under these conditions the pressure differential required for reopening becomes less because the total spring deflection is less. However the pressure differential to close the valve element 26 remains the same. This feature allows the valve 20 to be used in existing well installations with side pocket mandrels. The valve 20 can be set to accommodate the vertical spacing between such existing side pocket mandrels, and the reopening differential pressure set to prevent the valve from reopening too soon or too close to the closing pressure.

Another important feature of the present invention is the presence of a very long stem travel compared to other devices. These features, together with the large bore size of the seat ring 41 ensures that the ball element 84 moves far enough away from the seat ring that its effect on the passage of gas is very minimal, or nonexistent. The check valve 34 is designed for high injection rates with minimum pressure drop. These features in combination allow a variety of upstream chokes to be used to control the rate of injection through the valve 20. The structure and features of the orifice spool 54 are disclosed and claimed in my U.S. Pat. No. 4,625,941 issued in December, 1986.

As noted above, several valves 19 are spaced along the tubing 13 above the injection valve 20. The valves 19 are used to unload the annulus 17 of salt water or other liquid standing therein as gas lift is initiated. Lift gas under pressure is supplied to the annulus 17 via the surface line 18 and forces the liquid into the tubing 13 through open valves 19 until the lower end of the gas column reaches the lowermost injection valve 20. The gas pressure closes the uncovered valves 19 and maintains them closed as injection occurs through the lowermost valve 20. Since the pressure of the column of oil in the tubing 13 becomes progressively less at shallower depths. Thus the differential pressure holding the valves 19 closed increases so that they all remain closed. Lift gas injection occurs only through the lower valve 20.

It now will be recognized that a new and improved differential pressure operated gas lift valve has been disclosed which will allow a very high injection rate at low pressure differential without interference with other valves when very close spacing is necessary. Since certain changes or modifications may be made in the disclosed embodiment without departing from the inventive concepts involved, it is the aim of the appended claims to cover all such changes and modifications falling within the true spirit and scope of the present invention.

What is claimed is:

1. A gas lift valve adapted to open and enable lift gas to be injected from the annulus into the production tubing of an oil well in response to a first pressure differential and to close and shut off gas injection in response to a second pressure differential, comprising: a housing defining gas flow passage in communication with the tubing; a seat surrounding said gas flow passage; orifice means for communicating the annulus with said flow passage; valve means in said housing movable a predetermined distance from an open position away from said seat to a closed position against said seat; resilient means resisting movement of said valve means toward said closed position with a force that is proportional to said distance; and means for adjusting said distance to selectively set the pressure differential at which said resilient means will cause said valve means to open.

2. The valve of claim 1 further including means for setting the initial compression of said resilient means when said valve means is in said open position.

3. The valve of claim 1 wherein said adjusting means includes a member in said housing engaging said valve means and arranged to move said valve means axially toward and away from said seat.

4. The valve of claim 3 wherein said member has an annular skirt that engages said valve means, said skirt having an internal bore, and port means for communicating said bore with the well annulus to allow gas pressure to act on said valve member over a first transverse area defined by said bore.

5. The valve of claim 4 wherein said valve means includes an elongate stem, one end of said stem being conically tapered to provide annular line contact with said skin, said line contact defining the diameter of said transverse area.

6. The valve of claim 5 where engagement of seat with said valve means defines a second transverse area, said second transverse area being larger than said first transverse area.

7. A differential pressure responsive gas lift valve adapted to control the flow of gas into a tubular string that conducts fluids from a producing formation, comprising: a tubular housing having a flow passage adapted to be communicated with the interior of the tubular string; a valve seat surrounding said flow passage; said housing carrying orifice means through which gas under pressure from externally of said housing can flow through said passage and seat; an elongate valve member including a closure means movable in said housing between a closed position where said closure means engages said seat to prevent flow therethrough and an open position where said closure means is spaced from said seat to permit flow of gas; a first surface on said valve member subject to the pressure of gas externally of said housing for generating pressure forces tending to move said valve member toward said closed position; a second surface on said closure means subject to the pressure in the tubular string in said closed position to enable generating pressure forces tending to move said valve member toward said open position; resilient means applying opening force to said valve member; and means for adjusting the travel distance of said valve member between said closed and open positions.

8. The valve of claim 7 wherein said adjusting means includes means in said housing engaging said first surface, and means enabling the axial position of said engaging means to be moved toward and away from said valve seat.

9. The valve of claim 8 wherein said engaging means includes a mandrel having external threads engaging internal threads in :said housing, said mandrel having a skirt engaging said first surface, whereby rotation of said mandrel and skirt relative to said housing in one rotational direction advances said valve member toward said seat while compressing said resilient means, and rotation in the opposite direction allows said resilient means to shift said valve member away from said seat.

10. The valve of claim 7 wherein said orifice means includes an annular member surrounding said valve member and having at least one axially extending orifice having a flow area of substantially less size than the flow area of said passage to create a pressure drop that allows the pressure in said tubular string to act on said closure means in said open position.

11. A gas lift valve for use in controlling the flow of gas into a tubular production string from the exterior thereof, comprising: an elongate tubular body defining a gas flow passage and having outlet means connectible to the production string in communication with the interior thereof, said flow passage having inlet means through the wall of said body in communication with the exterior of said production string; orifice means between said inlet means and said flow passage; a first seat in said body surrounding said flow passage; an elongate valve member movable axially in said body and including closure means engaging said first seat in the closed position of said valve member and being spaced from said seat in an open position thereof; a second seat in said body axially spaced from said first seat, said valve member having a surface engaging said second seat in said open position and being spaced axially therefrom in said closed position; port means operable in said open position for communicating said surface with the exterior of said body; resilient means applying axial force to said valve member tending to move said valve member toward said open position; first means for adjusting the amount of said axial force; and second means for adjusting the axial spacing between said first and second seats to change the amount of travel of said valve member between its open and closed positions.

12. The valve of claim 11 wherein said first seat defines a first traverse cross-sectional area and the engagement of said surface with said second seat defines a second traverse cross-sectional area, said second area being smaller than said first area.

13. The valve of claim 12 wherein said second seat is formed on a mandrel mounted in said body; and further including coengageable axial cam means on said mandrel and said body responsive to relative rotation for shifting said second seat toward and away from said first seat.

14. The valve of claim 13 wherein said surface is conical to provide automatic centering of said valve member as said surface engages said second seat.

* * * * *